United States Patent [19]

Dean

[11] 4,015,687

[45] Apr. 5, 1977

[54] STEP BRACKET

[75] Inventor: Robert Dean, Owosso, Mich.

[73] Assignee: Spiral-Craft, Owosso, Mich.

[22] Filed: Jan. 8, 1976

[21] Appl. No.: 647,625

[52] U.S. Cl. ..... 182/220; 52/182; 52/191; 182/228; 248/248

[51] Int. Cl.[2] ..... E06C 7/08

[58] Field of Search ..... 52/182, 191; 108/92; 182/189, 220, 228; 248/247–250

[56] References Cited

UNITED STATES PATENTS

| | | | |
|---|---|---|---|
| 1,002,096 | 8/1911 | Todd | 52/191 |
| 2,818,945 | 1/1958 | Holzer | 52/191 |
| 3,667,572 | 6/1972 | Anderson | 182/220 |

*Primary Examiner*—James C. Mitchell
*Attorney, Agent, or Firm*—Gifford, Chandler, Sheridan & Sprinkle

[57] ABSTRACT

A novel step bracket is provided and is adapted for securing a step in a horizontal position to a downwardly sloping stringer. Preferably, the bracket is formed from a sheet of metal and comprises an upper horizontal portion secured to the bottom surface of a step. A generally triangularly shaped vertical section of the bracket extends downwardly from the horizontal portion and a flat portion is formed along the bottom edge of the vertical section and is perpendicular thereto. The plane of the flat portion is skewed relative to the horizontal plane so that the flat portion flatly abuts against the upper surface of the stringer. A downwardly extending vertical lip is formed along one edge of the flat portion section so that the lip flatly abuts against the side of the stringer. Fasteners are then used to secure the lip and the flat portion to the stringer and likewise to secure the upper horizontal portion to the step.

6 Claims, 6 Drawing Figures

FIG. 1
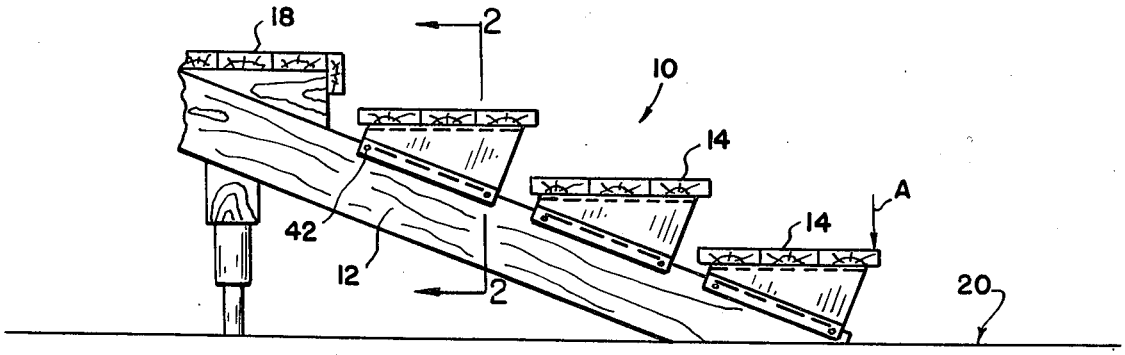
FIG. 2
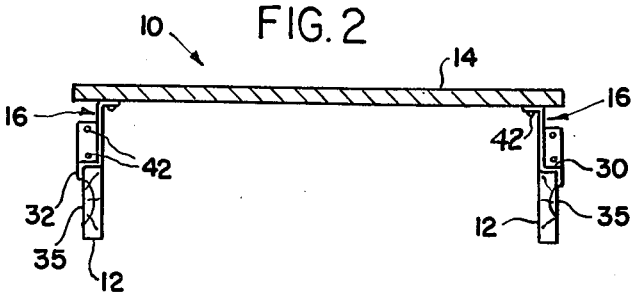
FIG. 3
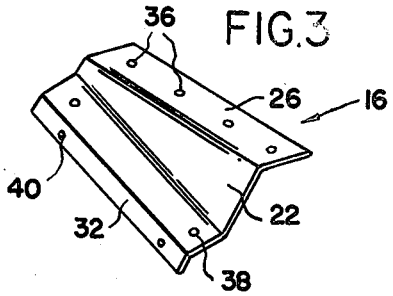
FIG. 5
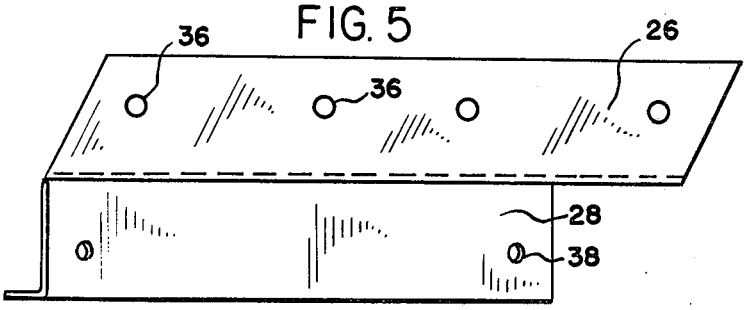
FIG. 6
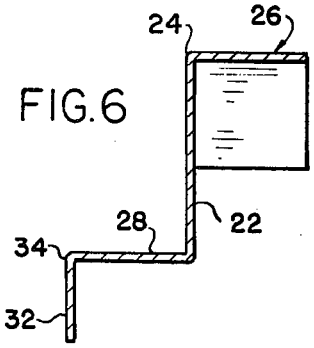
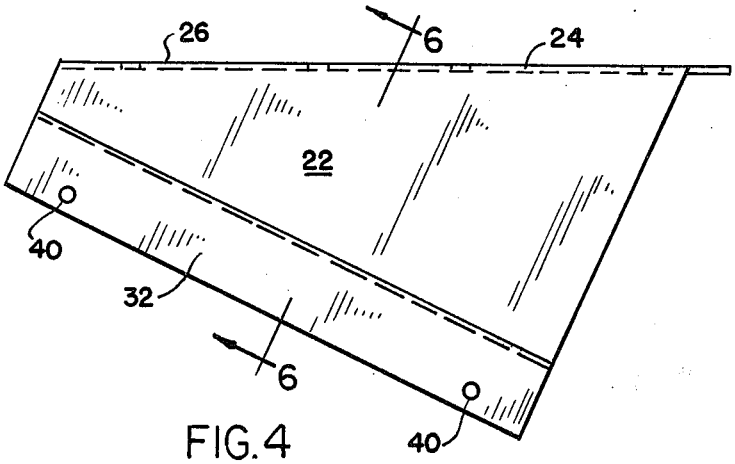
FIG. 4

STEP BRACKET

BACKGROUND OF THE INVENTION

1. Field of the Invention

The present invention relates generally to brackets and, more particularly, to a bracket adapted to secure an end of a step to a sloping stringer.

2. Description of the Prior Art

In the construction of stairs for basements, outside decks, porches, and the like it has been the previous practice to secure a pair of spaced and parallel stringers between the upper and lower level so that the stringers slop downwardly from the upper level to the lower level. A plurality of flat steps are then constructed and when properly positioned between the stringers, the steps are secured to the stringers by nails or the like.

This previously known stair construction is disadvantageous in several different aspects. First, the steps must be carefully measured and constructed. If the steps are too long, they will not fit between the stringers or, conversely, if the steps are too short a gap between the stringer and the step will result. Even if the steps are properly dimensioned, in practice it has proven awkward and difficult to accurately secure the steps between the stringers in a horizontal position. Consequently the upper surface of the step is often skewed relative to the horizontal plane which poses a serious safety hazard since persons tend to slip on non-horizontal steps.

A still further disadvantage of the previously known stair construction is that after a period of time the junction point of the step with the stringer weakens so that the step ultimately breaks away from the stringer when subjected to a heavy load. Needless to say, serious injuries may result when the step breaks away from the stringer as a person steps on it.

SUMMARY OF THE PRESENT INVENTION

The present invention obviates the above mentioned disadvantages of the previously known stair construction by providing a bracket for securing one end of a step to one stringer. The step bracket of the present invention comprises a triangularly formed section which lies substantially in a vertical plane. A horizontal portion is provided across the top edge of the vertical section and is adapted to be secured to the bottom surface of the step. An elongated flat section is provided across the lower edge of the vertical section so that the plane of the flat portion is substantially at a right angle to the plane of the vertical section. The plane of the flat portion is also angled with respect to the horizontal plane so that with the flat portion abutting against the upper surface of the sloping stringer, the horizontal portion is maintained in a substantially horizontal plane. A lip, formed along one lateral edge of the flat portion, extends downwardly from the flat portion and perpendicularly thereto so that the lip flatly abuts against the side of a stringer. Thus, when the step bracket of the present invention is properly positioned on the stringer, both the lip and flat portion are secured to the stringer while the horizontal portion is secured to the bottom surface of the step.

It can thus be seen that with the door step bracket of the present invention, steps may be rapidly and securely fastened to the stringer. In addition the steps are automatically maintained in a horizontal position by the step brackets of the present invention.

BRIEF DESCRIPTION OF THE DRAWINGS

The present invention will be more clearly understood by reference to the following detailed description when read in conjunction with the accompanying drawing, wherein like reference characters refer to like parts throughout the several views, and in which:

FIG. 1 is a side plan view showing a stair using the step bracket of the present invention;

FIG. 2 is a cross-section view taken substantially along line 2—2 in FIG. 1;

FIG. 3 is a perspective view showing the step bracket of the present invention;

FIG. 4 is a side plan view showing the step bracket of the present invention;

FIG. 5 is a top plan view showing the step bracket of the present invention; and FIG. 6 is a cross-section view taken substantially along line 6—6 in FIG. 4.

DETAILED DESCRIPTION OF THE PREFERRED EMBODIMENT

Referring first to FIGS. 1 and 2, a stair 10 is there shown comprising a pair of spaced and parallel stringers 12 supporting a series of steps 14 by means of the step bracket 16 of the present invention. Each stringer 12 may comprise, for example, a two inch by ten inch length of wood secured at one end to the upper level 18 and at its other end to a lower level 20 so that the stringers 12 slope downwardly from the upper level 18 to the lower level 20. Similarly each step 18 may comprise a single flat board or may comprise a number of narrower boards placed side by side on top of the bracket 16 and laterally across the top of the stringers 12.

As best shown in FIGS. 2, 5, and 6, each step bracket 16 includes a triangular or trapezoidal vertical section 22, hereinafter referred to as triangularly shaped, which lies substantially in a vertical plane when assembled onto the stringer 12. Along the upper horizontal edge 24 of the vertical section 22, a horizontal portion 26 is provided substantially perpendicularly to the vertical section 22 so that the horizontal portion 26 lies in a generally horizontal plane. The step bracket 16 is secured to the stringer 12 in a manner to be shortly described.

An elongated flat portion 28 is provided along the lower edge of the vertical section 22 and generally perpendicular thereto as best shown in FIG. 6. The plane of the flat portion 28 is angled relative to the horizontal plane at substantially the same angle that the stringers 12 are angled to the horizontal plane. Consequently when the flat portion 28 of the step bracket 16 is positioned on the upper surface 30 of the stringer 12 (FIGS. 1 and 2), the horizontal portion 26 is automatically maintained in a horizontal plane.

An elongated lip 32 is disposed along the outwardly extending lateral edge 34 of the flat portion 28 and extends downwardly from the flat portion 28 and generally perpendicular thereto. Thus with the flat portion 28 flatly abutting against the upper surface 30 of the stringer 12, the lip 32 abuts against the side 35 of the stringer 12.

As is best shown in FIGS. 3–5, a plurality of apertures 36 are provided through the upper horizontal portion 26 of the step bracket 16. Likewise a number of spaced apertures 38 are provided through the flat portion 28 while, likewise, at least a pair of spaced apertures 40 are provided through the lip 32. Fasteners 42, such as nails or screws, are inserted through the apertures 36 in the upper horizontal portion 26 and into the step 14 to secure the step 14 to the step bracket 16. Similarly, fasteners 42 are disposed through the apertures 38 and 40 in the flat portion 28 and lip 32 to secure the step bracket 16 to the stringer 12 and, as should be apparent from FIG. 2, one step bracket 16 is secured to each stringer 12 for each step 14. The fasteners 42 through the lip 32 function to retain the bracket 16 to the riser 12 when a torque force is applied to the bracket 16. Such a torque force would occur, for example, when a load is applied in the direction of arrow "A" in FIG. 1. Without the lip 32, the fasteners through the flat portion 28 would tend to pull out from the stringer 12 under such a torque force.

Although each portion and section of the bracket 16 may be separately constructed and secured together by conventional means, such as welding, preferably the bracket 16 is of integral construction for both rigidity and reduced manufacturing costs.

It can thus be seen that the step bracket of the present invention provides a novel means for securing a step to a downwardly sloping stringer. The present invention not only eliminates the necessity of precisely constructing each step but also provides a more rigid connection between the step and the stringer than has been previously known. Moreover, the entire stairway may be much more rapidly constructed by utilizing the step bracket 16 of the present invention than by previously known methods.

Having described my invention, many modifications thereto will become apparent to those skilled in the art to which it pertains without deviating from the spirit of the invention as defined by the scope of the appended claims.

I claim:

1. A step bracket adapted for securing a step to a stringer which stringer is sloped to the horizontal at a predetermined angle and wherein said step is substantially level with the horizontal slope, said step bracket comprising a first elongated flat portion positioned on top of and abutting said stringer, said first portion having at least two apertures formed therethrough;

a second flat and triangularly shaped portion disposed in a vertical plane and having its lower edge secured to one lateral edge of said first portion and having its upper edge generally horizontal, a third flat portion disposed in a horizontal plane and having one end secured to the upper edge of said second portion, said third portions having at least two spaced apertures formed therethrough;

a fourth flat portion disposed in a vertical plane and having its upper edge secured to the other lateral edge of said first portion, wherein said fourth portion flatly abuts against the side of said stringer and includes at least two spaced apertures formed therethrough, and means for fastening said step to said bracket and said bracket to said stringer.

2. The bracket as defined in claim 1 and in which said last mentioned means includes a first fastening means for securing said step to the upper surface of said third portion.

3. The bracket as defined in claim 1 and in which said last mentioned means includes a second fastening means for securing said first portion to the upper surface of said stringer.

4. The bracket as defined in claim 1 and in which said last mentioned means includes a third fastening means for securing said fourth portion to the side of said stringer.

5. The bracket as defined in claim 1 and in which said last mentioned means comprises first fastening means for securing said step to the upper surface of said third portion, second fastening means for securing said first portion to the upper surface of said stringer, and third fastening means for securing said fourth portion to the side of said stringer.

6. The step bracket as defined in claim 1, wherein said first, second, third and fourth portions are integral with each other.

* * * * *